US009982380B2

(12) United States Patent
Ahn

(10) Patent No.: US 9,982,380 B2
(45) Date of Patent: May 29, 2018

(54) LAUNDRY MACHINE

(75) Inventor: In Geun Ahn, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 2536 days.

(21) Appl. No.: 11/629,660

(22) PCT Filed: Mar. 23, 2006

(86) PCT No.: PCT/KR2006/001069

§ 371 (c)(1),
(2), (4) Date: Jul. 24, 2007

(87) PCT Pub. No.: WO2006/101358

PCT Pub. Date: Sep. 28, 2006

(65) Prior Publication Data

US 2011/0138864 A1 Jun. 16, 2011

(30) Foreign Application Priority Data

Mar. 25, 2005 (KR) ..... 10-2005-0025128

(51) Int. Cl.

| | |
|---|---|
| ***D06F 25/00*** | (2006.01) |
| ***D06F 35/00*** | (2006.01) |
| ***D06F 39/00*** | (2006.01) |
| ***D06F 39/08*** | (2006.01) |
| ***D06F 58/20*** | (2006.01) |

(52) U.S. Cl.

CPC ..... *D06F 25/00* (2013.01); *D06F 35/00* (2013.01); *D06F 39/008* (2013.01); *D06F 39/088* (2013.01); *D06F 58/203* (2013.01)

(58) Field of Classification Search

CPC ..... D06F 25/00; D06F 35/00; D06F 39/008; D06F 39/088; D06F 58/203

USPC ..... 68/15, 12.19, 5 C

See application file for complete search history.

(56) References Cited

U.S. PATENT DOCUMENTS

| | | | | | |
|---|---|---|---|---|---|
| 1,607,120 | A | * | 11/1926 | Doble | 60/667 |
| 2,453,210 | A | * | 11/1948 | Eaton | 392/328 |
| 2,485,762 | A | * | 10/1949 | Mittendorf | 392/326 |
| 2,989,070 | A | * | 6/1961 | Sulzmann | 137/334 |
| 3,172,266 | A | * | 3/1965 | Strohmeyer, Jr. | 60/656 |
| 3,242,584 | A | * | 3/1966 | Jacobs | 34/448 |
| 3,584,193 | A | * | 6/1971 | Badertscher | 392/328 |
| 3,869,815 | A | * | 3/1975 | Bullock | 38/77.6 |
| 3,921,308 | A | * | 11/1975 | Freze | 34/395 |

(Continued)

FOREIGN PATENT DOCUMENTS

| | | | |
|---|---|---|---|
| CN | 1534129 | | 10/2004 |
| DE | 25 14 771 | * | 9/1976 |

(Continued)

OTHER PUBLICATIONS

European Patent Office 0 302 125 dated Feb. 1989.*

Japan'595, "JP02198595 English Machine Translated Abstract. pdf", Aug. 7, 1990—Machine translation from PAJ.*

*Primary Examiner* — Levon J Shahinian

(74) *Attorney, Agent, or Firm* — Dentons US LLP

(57) ABSTRACT

A laundry machine includes a body for defining an exterior; a water supply valve provided in the body and connected with an outer water supply; a drum rotatably mounted within the tub; at least one steam generator to supply steam ino the drum; and a water-adjust-valve to adjust the water amount supplied to the steam generator.

21 Claims, 6 Drawing Sheets

(56) References Cited

U.S. PATENT DOCUMENTS

| | | | | | |
|---|---|---|---|---|---|
| 3,944,785 | A | * | 3/1976 | Eaton-Williams | 392/326 |
| 4,177,928 | A | * | 12/1979 | Bergkvist | 239/129 |
| 5,029,458 | A | * | 7/1991 | Obata et al. | 68/19.2 |
| 5,290,511 | A | * | 3/1994 | Newman | 422/26 |
| 6,094,523 | A | * | 7/2000 | Zelina et al. | 392/399 |
| 7,235,109 | B2 | * | 6/2007 | Kleker | 8/149.3 |
| 2002/0133886 | A1 | | 9/2002 | Severns et al. | |
| 2004/0187529 | A1 | | 9/2004 | Kim et al. | |
| 2005/0034489 | A1 | | 2/2005 | Oh et al. | |
| 2005/0072383 | A1 | * | 4/2005 | Powell et al. | 122/483 |

FOREIGN PATENT DOCUMENTS

| | | | |
|---|---|---|---|
| DE | 7715877 | | 9/1977 |
| DE | 31 03 529 | * | 8/1982 |
| GB | 2 179 259 | * | 3/1987 |
| JP | 61-002226 | | 6/1984 |
| JP | 62-199079 | | 6/1986 |
| JP | 02-198595 | * | 8/1990 |
| JP | 10-071292 | * | 3/1998 |
| JP | 2003-093775 | * | 4/2003 |
| JP | 2003-181392 | | 7/2003 |
| JP | 2003-311084 | | 11/2003 |
| JP | 2003-320324 | | 11/2003 |
| KR | 20-1993-0021684 | | 10/1993 |
| KR | 10-1999-0085040 | | 12/1999 |
| KR | 10-2001-0018295 | | 3/2001 |
| KR | 10-2004-0088885 | | 10/2004 |
| KR | 10-2005-0018182 | | 2/2005 |

* cited by examiner

[Fig. 1]
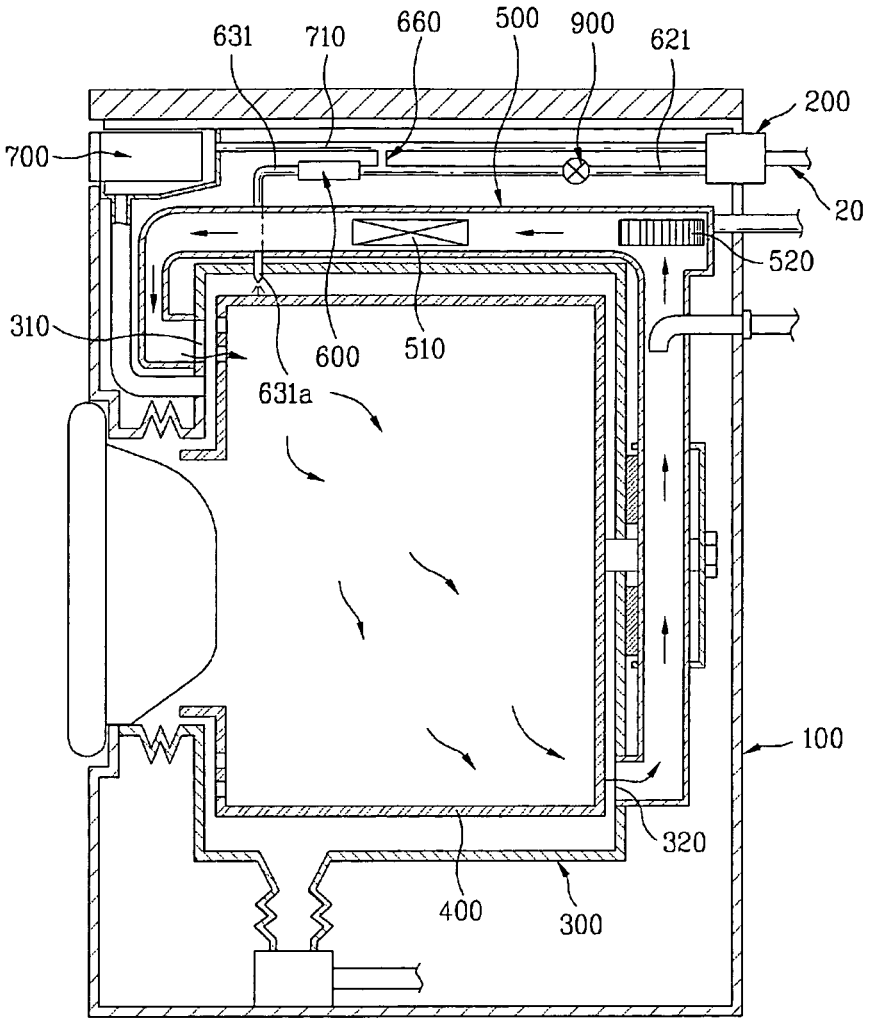

[Fig. 2]
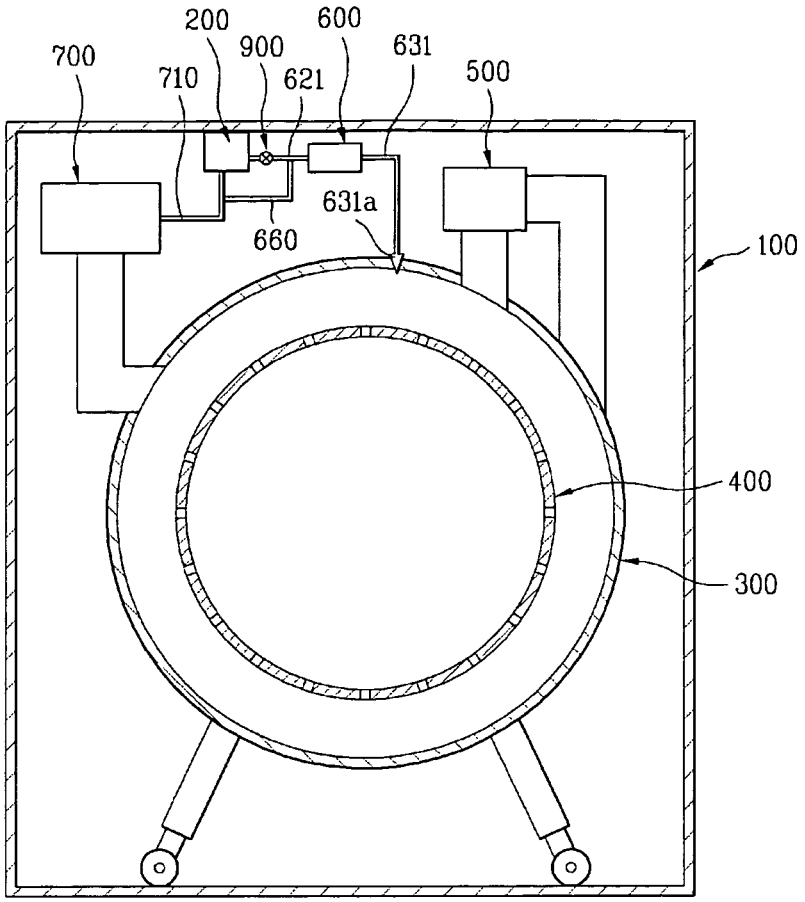

[Fig. 3]
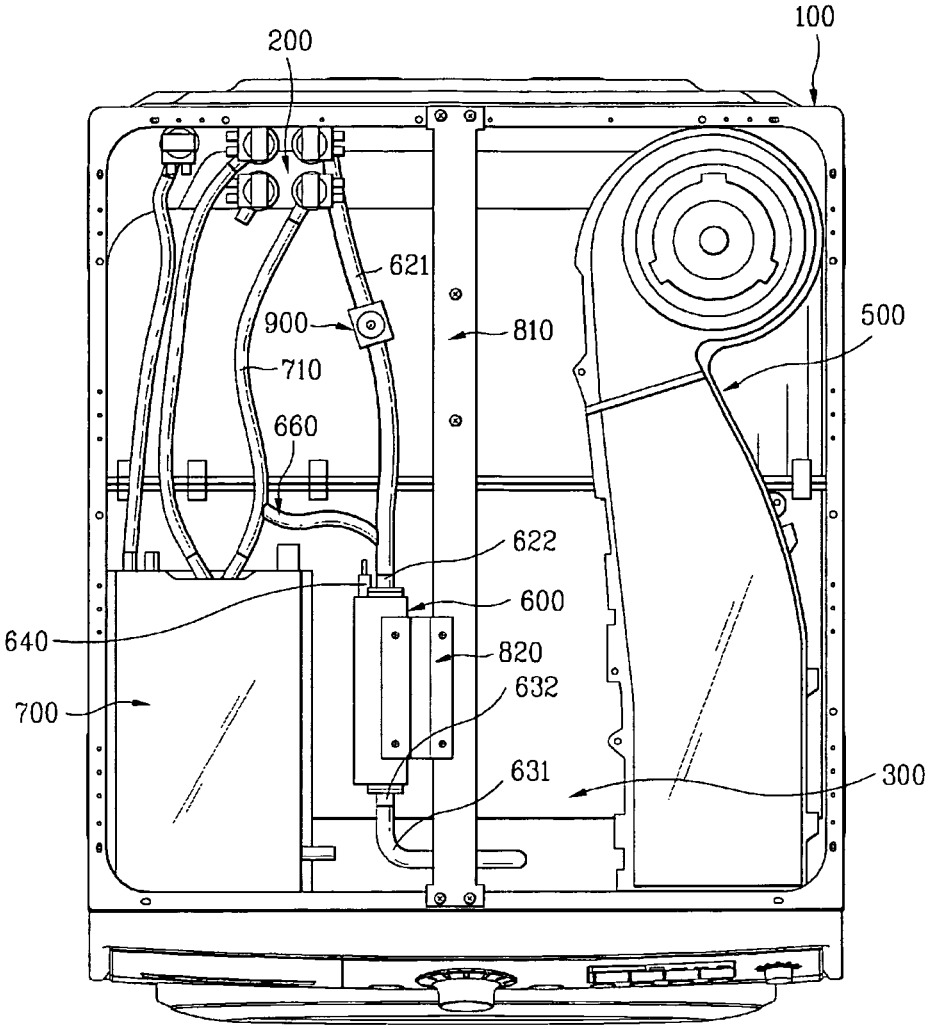

[Fig. 4]
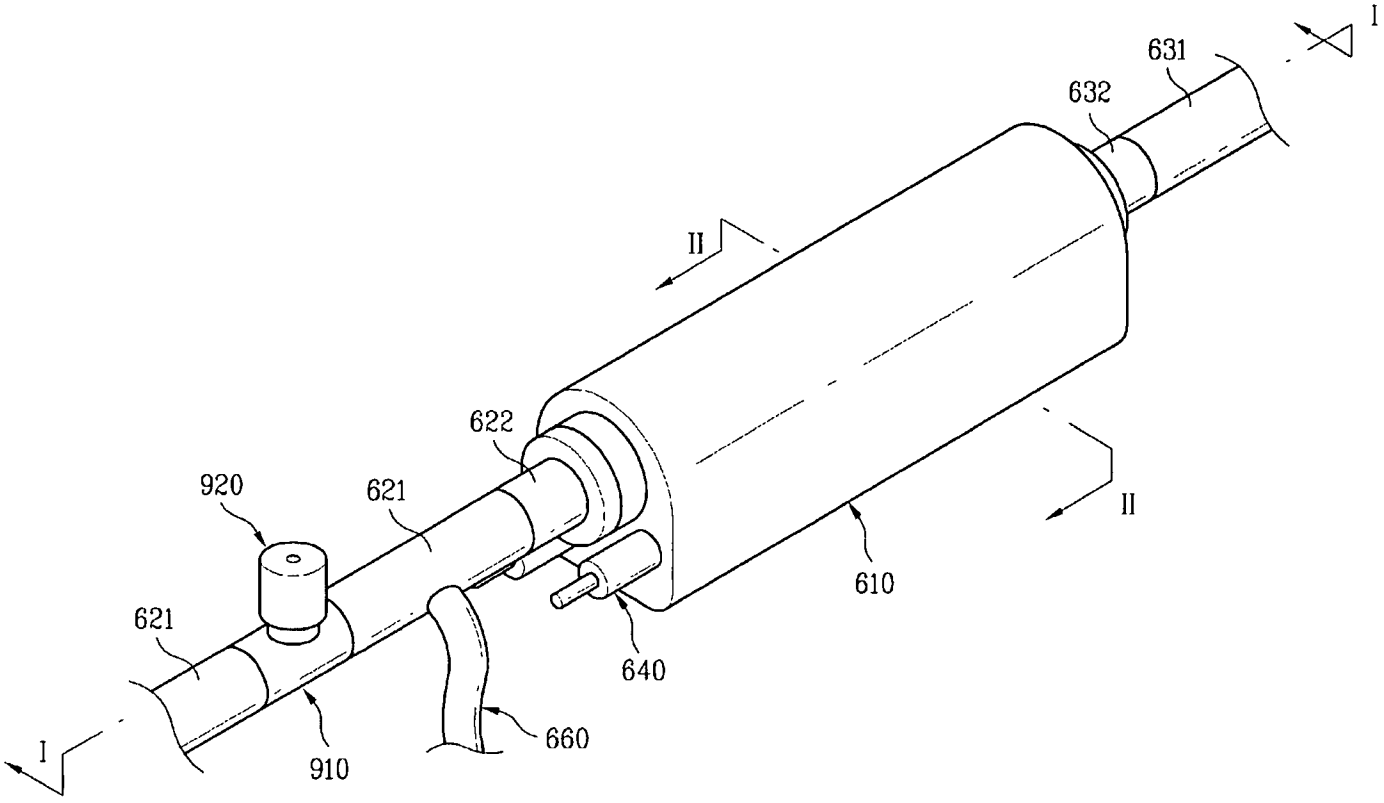

[Fig. 5]
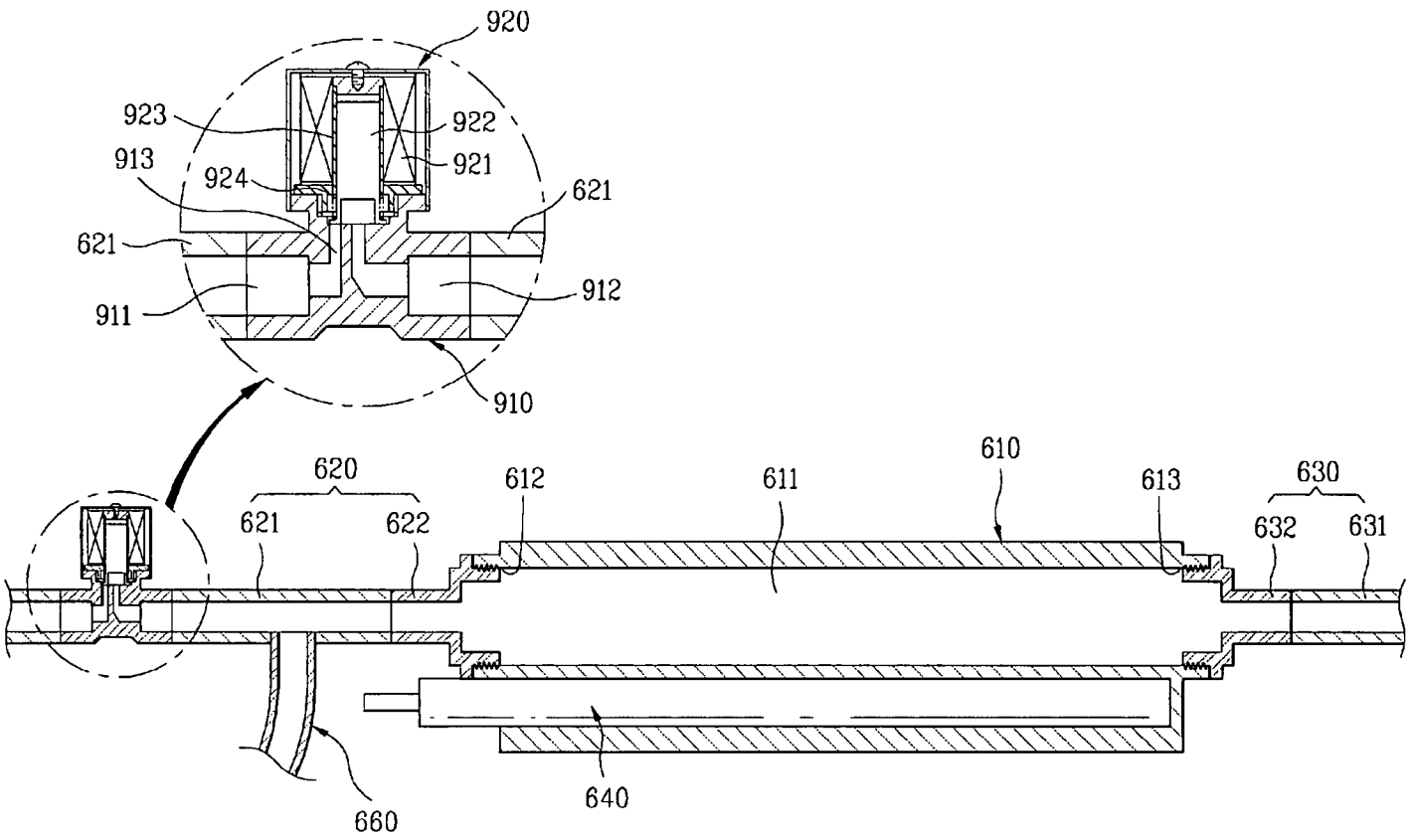

[Fig. 6]
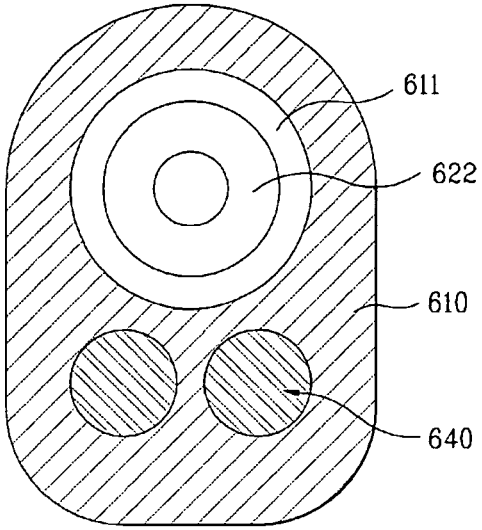
[Fig. 7]
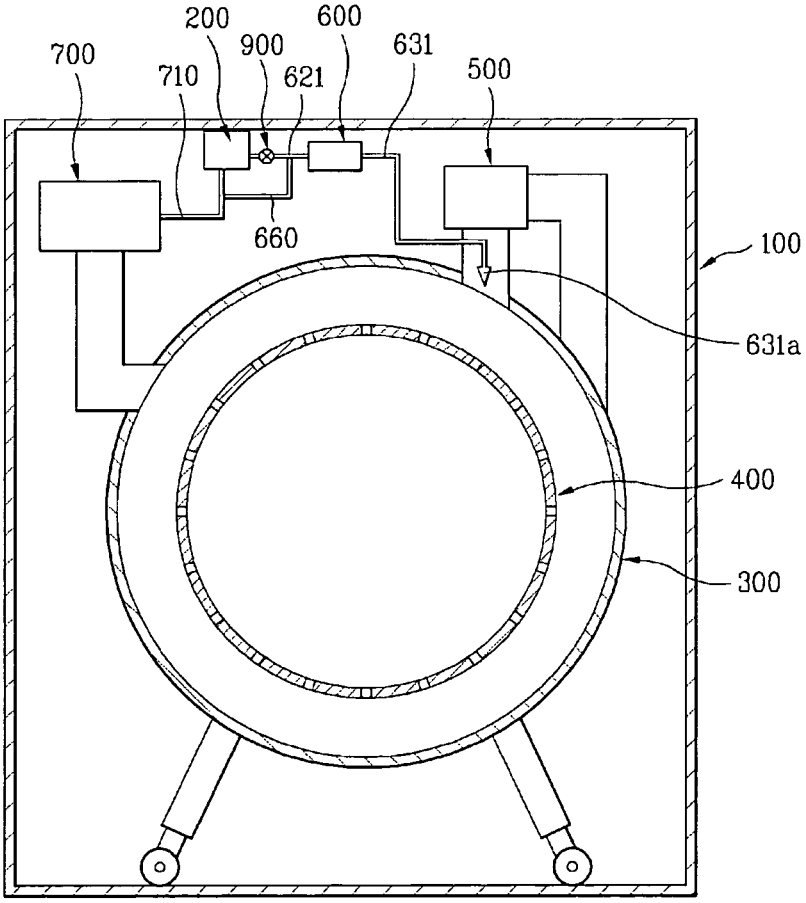

LAUNDRY MACHINE

This application claims priority from PCT Application PCT/KR2006/001069, filed Mar. 23, 2006, and Korean Application 10-2005-0025128, filed Mar. 25, 2005, which are hereby incorporated by reference in its entirety.

TECHNICAL SOLUTION

The present invention relates to a laundry machine, and more particularly, to a steam generator for washing/drying laundry fast and efficiently as well as for having a refreshing effect of sterilizing the laundry and smoothing cut wrinkles of the laundry, and a laundry machine having the same.

BACKGROUND ART

In general, a drum type laundry machine washes laundry by using both friction force between a drum rotated by a motor and the laundry, in a state where the laundry and detergent are mixedly loaded into a drum. Thus, the drum type laundry machine has an effect that the laundry may not be damaged, nor get entangled, and that the laundry may be washed as if it were scrubbed by human hands.

Also, a drum type laundry machine with a drying function is an appliance capable of not only washing laundry like a conventional drum type laundry machine but also drying washed laundry.

Here, the drum type laundry machine with a drying function dries the laundry by hot air supplied into a drum through a drying duct having a drying heater and a ventilating fan therein.

However, the conventional drum type laundry machine has following problems.

First, the conventional drum type laundry machine has a problem of much consumption of wash water, because a soaking cycle using a lot of wash water should be performed before washing.

That is, since the laundry should be dampened in wash water in a soaking cycle, a lot of wash water is needed.

Second, the conventional drum type laundry machine has another problem that any auxiliary structure is not provided therein for sterilizing the laundry.

Thought not shown in drawings, recently there has been released a laundry machine which has another heater for wash water therein for sterilizing the laundry, but that laundry machine is not preferred due to too much consumption of wash water as well as energy used in a sterilizing cycle, because the laundry is simply sterilized in wash water.

Finally, the conventional drum type laundry machine has still another problem of inconvenience that additional ironing is necessary due to wrinkles generated in washing.

Especially, when a drying cycle is performed within the drum in spite of a lot of wrinkles, it is more difficult as well as inconvenient for a user to iron the laundry with the wrinkles.

DISCLOSURE OF INVENTION

Technical Problem

An object of the present invention is to provide a laundry Machine which can perform washing and drying more quickly and efficiently as well as which has an effect of smoothing cut wrinkles and sterilizing the laundry.

Technical Solution

To achieve these objects and other advantages and in accordance with the purpose of the invention, as embodied and broadly described herein, a laundry machine. A laundry machine comprises a body for defining an exterior; a water supply valve provided in the body and connected with an cuter water supply apparatus; a tub provided within the body; a drum rotatably mounted within the tub; at least one steam generator for supplying steam into the drum; and a water-adjust-valve for adjusting the water amount supplied to the steam generator.

The water-adjust-valve is in a pipe connecting the water supply valve and the steam generator. Preferably, the water-adjust-valve is a solenoid valve which opens/closes a path receiving water once the power is applied thereto.

The water-adjust-valve adjusts the water amount supplied to the steam generator by periodically repeating of the opening/closing operation.

More specifically, the water-adjust-valve comprises a valve body having an inlet formed at a first side thereof for drawing water, an outlet formed at a second side thereof for discharging water and a water-trough hole formed between the inlet and the outlet; and a valve driving part for opening/closing the water-through hole by the power on/off.

Also more specifically, the steam generator comprises a steam generating part having a predetermined water inflow space therein for allowing water to flow therein, the steam generating part having a water inlet and an outlet respectively connected with the water inflow space; a water inlet path connecting between the water supply valve and the water inlet of the steam generating part; an outlet path connecting between the outlet of the steam generating part and the tub; and a heater for heating water flown to the water inflow space to generate steam.

The steam generating part is provided within the body of the laundry machine so that the outlet may be positioned higher than the water inlet based on a horizon.

Preferably, the cross section of the steam generating part is larger than the cross section of the water inlet path and of outlet path, and the cross section of the outlet path is smaller than the cross section of the water inlet path.

Meanwhile, the water inlet path includes a water supply pipe having a first end thereof connected with the water supply valve; and a water inlet pipe having a first end connected with the second end of the water supply pipe and a second end thereof connected with the water inlet of the steam generating part. Here, the water-adjust-valve is in the water supply pipe. Also, the seam generator further includes a bypass path for discharging water over flown from the water inflow space of the steam generating part. In that case, preferably, an end of the bypass path discharging water is in a water supply pipe way between the water-adjust-valve and the water inlet pipe.

More specifically, the outlet path includes an outlet pipe having a first end thereof connected with the outlet of the steam generating part; and a steam supply pipe having a first end connected a second end of the outlet pipe and a second end thereof connected with the tub. Preferably, the end of the steam supply pipe discharging steam is formed in a nozzle shape.

In another aspect of the present invention, a laundry machine includes a body for defining an exterior; a water supply valve provided in the body and connected with an outer water supply apparatus; a tub provided within the body; a drum rotatably mounted within the tub; a hot air supply device for generating and supplying hot air into the drum through the drying duct; at least one steam generator for supplying steam into the drum; and a water-adjust-valve for adjusting the water amount supplied to the steam generator from the water supply valve.

Preferably, the steam generated in the steam generator is supplied into the drum through the drying duct.

Advantageous Effects

The present invention has an advantageous effect of enhanced washing efficiency as well as economizing in wash water in a washing cycle.

Furthermore, the present invention has another advantageous effect of enhanced drying efficiency as well as removing wrinkles of laundry and sterilizing the laundry in a drying cycle.

Still further, the present invention has another advantageous effect of enhancing user satisfaction due to the refreshing function of laundry.

Still further, the present invention has another advantageous effect of generating and supplying steam more efficiently the to smooth wash water supply of the steam generator in case of the counter-pressure of water in the steam generator.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a side sectional view schematically illustrating a drum type laundry machine with a drying function according to an embodiment of the present invention.

FIG. 2 is a front sectional view schematically illustrating the structure of drum type laundry machine with a drying function according to the first embodiment of the present invention.

FIG. 3 is a sectional view schematically illustrating a drum type laundry machine with a drying function according the first embodiment of the present invention.

FIG. 4 is a perspective view schematically illustrating a steam generator of FIG. 3.

FIG. 5 is a sectional view in accordance with a of FIG. 4.

FIG. 6 is a sectional view in accordance with a line of FIG. 4.

FIG. 7 is a front sectional view schematically illustrating another embodiment of steam supplying structure according to the drum type laundry machine with a drying function of the present invention.

BEST MODE FOR CARRYING OUT THE INVENTION

Reference will now be made in detail to the preferred embodiments of the present invention, examples of which are illustrated in the accompanying drawings. This embodiment presents a drum type laundry machine as an example of a laundry machine according to the present invention.

FIG. 1 is a side sectional view schematically illustrating a drum type laundry machine with a drying function according to an embodiment of the present invention. FIG. 2 is a front sectional view schematically illustrating the structure of drum type laundry machine with a drying function according to the first embodiment of the present invention. FIG. 3 is a sectional view schematically illustrating a drum type laundry machine with a drying function according the first embodiment of the present invention.

Although a drum type laundry machine is embodied on convenience sake, the present invention is not limited to a drum type laundry machine, and also may be applied to a laundry machine which can perform washing, dehydrating and drying respectively or simultaneously. For example, even in case of a dryer only performing drying, a steam generator according to the present invention may be applied thereto.

Moreover, FIG. 4 is a perspective view schematically illustrating a steam generator of FIG. 3. FIG. 5 is a sectional view in accordance with a I-I line of FIG. 4. FIG. 6 is a sectional view in accordance with a line of FIG. 4. FIG. 7 is a front sectional view schematically illustrating another embodiment of steam supplying structure according to the drum type laundry machine with a drying function of the present invention.

As shown in FIGS. 1 and 2 a drum type laundry machine with a drying function includes a body 100 for defining an exterior, a water supply valve 200 provided within the body 100 and connected with an cuter water supply apparatus 20, a tub 300 of an approximately cylindrical shape mounted within the body 100 for having a hot air inlet 310 and a hot air outlet 320 formed therein, a drum 400 rotatably mounted within the tub 300, a drying duct 500 having a drying heater 510 for heating air supplied into the drum 400 and ventilation fan 520 for forcibly ventilating the hot air heated by the drying heater 510 into the drum 400 to form an air inflow for supplying hot air, at least one of steam generators 600 for supplying steam into the drum 400, and a water-adjust-valve 900 for adjusting the water amount supplied into the steam generator 600 from the water-supply-valve 900.

Here, the drying heater 510, the ventilation fan 520 and drying duct 500 are employed for supplying hot air into the drum, and thereby they may be included in a hot air supply device.

As shown in FIGS. 3 to 6, the steam generator 600 with predetermined water inflow space 611 flowing water therein includes a steam generating part 610 having a water inlet 612 and an outlet 613 respectively connected with the water inflow space 611, a water inlet path 620 connected between the water supply valve 200 and the water inlet 612 of steam generating part 610, an outlet path 630 connected between the outlet 613 of the steam generating part 610 and the tub 300, a bypass path 660 for discharging overflowing water from the water inflow space 611 of steam generating part 610, and a heater 640 for heating the water flown to the water inflow space 611 of steam generating part 610.

Also, the steam generator 600 further includes a temperature sensor (not shown) for sensing the temperature of steam generating part 610.

The temperature sensor is provided so as to control the heater 640 based on the temperature of steam generating part 610. Preferably, the heater 640 is prevented from being overheated, because a temperature fuse is cut off at the temperature higher than the predetermined temperature and power supplying to the heater is shut off.

As shown in FIGS. 4 to 6, since the steam generating part 610 is formed in a tube shape, the water inflow space 611 is also formed in a tube shape. The water inlet 612 and the outlet 613 of steam generating part 610 are respectively formed at opposite ends of steam generating part 610.

Also, the steam generating part 610 is inclined such that the outlet 613 is positioned higher than the water inlet 612 based on a horizon. Thereby, water is prevented from being discharged though the outlet 613.

The cross section of water inflow space 611 in the steam generating part 610 is larger the cross section of water inlet path 620 and the cross section of outlet path 630 to smoothly supply water into the water inflow space 611 as well as to smoothly discharge steam from the water inflow space 611.

Also, preferably the cross section of outlet path 630 is smaller than the cross section of water inlet path 620.

That is for steam to be discharged into the outlet path 630 more smoothly by causing pressure difference between the inside of outlet path 630 and the inside of water inlet path 620, which is generated by water flowing into the water inflow space 611 from the water inlet path 620.

Preferably, the steam generating part 610 is made of metal with good conductivity and with small specific gravity such as aluminum in a die-casting method.

The water inlet path 620 includes a water supply valve 200 (see FIG. 3), a water supply pipe 621 connected with the water supply valve and a water inlet pipe interposed between the water supply pipe 622 and the water inlet pipe of the steam. generating part 610.

Also, the outlet path 630 includes an outlet pipe 632 provided in the outlet of the steam generating part 610, and a steam supply pipe 631 connected between the outlet pipe 632 and the tub 300.

As shown in FIG. 1, it is preferred that the end of steam supply pipe 631*a* discharging steam is formed in a nozzle shape.

Alternatively, as shown in FIG. 7, the steam generated in the steam generator 600 may be supplied into the drying duct 500, and then may be supplied into the drum 400 through the drying duct 500.

That is, the steam supply pipe 631 is connected between the outlet 613 of the steam generating part 610 and the drying duct 500 for supplying steam into the drum 400 through the drying duct 500.

Preferably, the end of steam supply pipe 631 discharging steam is provided at the end of drying duct 500 discharging hot air.

Also, preferably, the ventilation fan 520 is operated in case that the steam discharged from the steam supply pipe 631 is supplied into the drying duct 500.

That is for preventing the steam discharged from the steam supply pipe 631 from flowing against the inflow direction of hot air.

Alternatively, in case that the steam discharged from the steam supply pipe 631 is supplied into the drying duct 500, it is preferred to drive a ventilation fan 520 within the drying duct 500 for preventing the steam discharged by the steam supply pipe 631 from flowing against the inflow direction of hot air in the drying duct 500.

Of course, in case that the steam discharged by the steam supply pipe 631 is supplied into the drying duct 500, the steam of the dying duct 500 may be supplied with the hot air into the drum by driving the drying heater 510, together with driving the ventilation fan 520 within the drying duct 500.

Referring to FIGS. 3 to 5, the bypass path 660 is connected between the water inlet path 620 of the steam generating part 610 and the path drawing water from the water supply valve 200 into the tub 300.

In other words, as shown in FIG. 3, a drawer for detergent and fabric softener is provided between the water supply valve 200 and the tub 300 for mixedly supplying wash water and detergent/fabric softener. Thus, preferably the bypass path 660 is provided on the pipe 710 connecting the water supply valve 200 with the drawer for detergent 700.

That is, the bypass path 660 is connected between the pipe 710 and the water supply pipe 621 of water inlet path 620.

Although not shown, the bypass path 660 may be directly connected with the drawer for detergent/fabric softener 700, such that water over flown from the water inflow space of steam generating part 610 into the drawer for detergent/fabric softener 700.

Again, referring to FIGS. 4 to 6, preferably the heater 640 of steam generator 600 is a sheath heater, and is embedded within the steam generating part 610 by molding and provided in surroundings of the water inflow space 611 for heating the water flowing in the water inflow space 611.

That is, since the heater 640 is embedded within the steam generating part 610 for heat-radiating, the steam generating part 610 made of aluminum is heated, such that the water flowing within the water inflow space 611 of the steam generating part 610 is heated to generate steam.

As shown in FIG. 3, the steam generator 600 with the above configuration is provided by using a bracket 810 and 820, not using the body 100 defining an exterior of the drum type laundry machine with a drying function.

An auxiliary frame 810 is provided along a front/rear direction of the body 100, and a first side of a support bracket 820 is fastened to the front side of auxiliary frame 810 and a second side of a support bracket 820 is fastened to the steam generating part 610, such that the steam generator 600 is installed in the body 100 of the drum type laundry machine with a drying function.

Preferably, the steam generating part 610 and the second side of support bracket 820 are fastened by a screw.

Although not described specifically, a fastening boss having a fastening hole is projected on the upper surface of steam generating path 610, and a fastening hole corresponding with the fastening boss is formed in the second side of support bracket 820, such that the steam generating part 610 and the support bracket 820 are connected by fastening the screw to the fastening boss and the fastening hole.

Additionally, the auxiliary fame 810 is employed for dampening vibration and noise generated in the body in a spinning cycle, as well as for reinforcing the strength of body 100.

As shown in FIG. 3, a water-adjust-valve 900 is provided on the water inlet path 620 connecting the water supply valve 200 and the steam generator 600.

Here, the water-adjust-valve 900 adjusts water to be regularly supplied into the steam generator 600 without deviation according to time basis. For example, there may be always possibilities that the water amount is variable according to the water pressure variation of cuter water supply apparatus. That is, when the water pressure of outer water supply apparatus is high, much amount of water is supplied into the steam generator for a short time. Whereas, when the water pressure of cuter water supply apparatus is low, relatively little amount of water is supplied into the steam generator.

In the steam generator 600 where supplied water might be phase-changed into steam, the water amount supplied per predetermined time is very important, because supplied water may not be phase-changed into steam.

In other words, if much amount of water is supplied for a short time compared with the capacity of heater, steam mixed with water may be generated. Otherwise, overheated steam is generated or the heater is overheated.

Thus, it is quite important to adjust the water amount supplied per predetermined time, and the water-adjust-valve 900 is employed for that function.

The water-adjust-valve 900 is provided on the water supply pipe 621 of water inlet path 620 in the steam generator 600.

At that time, the water-adjust-valve 900 is provided in the water supply pipe 621 and preferably adjacent to the steam generating part 610.

Hence, the water-adjust-valve 900 is a solenoid valve adjusting the water amount supplied into the steam generating part 610 by opening or closing the passage of water supply pipe 621, when power is applied.

As shown in FIG. 5, the water-adjust-valve 900 includes an inlet 911 formed at a first side thereof for drawing water therein, an outlet 912 formed at a second side thereof for discharging the water, a valve body 910 having a water-through-hole 913 between the inlet 911 and the outlet 912, and a valve driving part 920 for opening/closing the water-through hole 913 by power on/off.

At that time, the valve driving part 920 includes a coil 921 for allowing the power applied thereto, a plunger 922 for moving upwardly to open the water-through-hole 913 when the power applied, a cylinder 923 for guiding the plunger 922 to move upwardly/downwardly, and a compression spring 924 for supplying the restitution of plunger 922.

The water amount supplied into the water inflow space 611 of the steam generating part 610 from the water supply valve 200 is adjusted by the water-adjust-valve 900.

Once the power is applied to the coil 921, the plunger 922 surrounded with the coil 921 becomes an electromagnet and receives magnetism to move upwardly along the cylinder 923, such that the water-through-hole 913 is opened.

Hence, when the power is shut off in that state, the plunger 922 quickly moves downwardly by the restitution of compression spring 924 to close the water-through-hole 913 of valve body 910.

Thus, since the water-adjust-valve 900 repeatedly opens/closes the water-through-hole, the regular amount of water may be supplied to the water inflow space 611 of steam generating part 610 from the water supply valve 200.

The reason why the water amount supplied into the steam generator 600 from the water supply valve 200 by the water-adjust-valve 900 should be adjusted is as follows.

While the steam generator 600 is operated, the outlet 613 of steam generating part 610 discharging steam is high in the temperature than the water inlet 612 drawing water.

Hence, counter-pressure may arise between the water inlet 612 and the outlet 613 due to the above temperature difference, and then water may go backwardly from the outlet 613 to the water inlet 612.

Thus, since water is not supplied into the water inflow space 611 of steam generating part 610 by the water inlet 612 smoothly, steam may be generated not consistently, but intermittently, thereby steam supplying being inefficient.

Accordingly, the water passage is opened/closed by the on/off operation of water-adjust-valve 900 or by the open angle adjusting the operation of water-adjust-valve 900, such that water may be supplied smoothly to generate steam consistently in case counter-pressure arises in the steam generating part 610.

That is, the water-adjust-valve 900 pumps water against counter-pressure in the steam generating part 610 for supplying water smoothly, such that steam may be generated and supplied efficiently.

Although not described, the water-adjust-valve 900 may be varied in various structures having an on/off function.

Next, the operation of steam generator in the drying type laundry machine with a drying function will be described according to the embodiment of the present invention.

First, in a washing cycle of the drum type laundry machine with a drying function, the operation of steam generator will be described.

Once a washing cycle starts in the drum type laundry machine with a drying function, wash water and detergent are mixedly loaded into a drum 400 and at the same time the steam generator 600 is operated to supply high-temperature steam into the drum 400 through a tub 300.

Thus, washing efficiency may be enhanced even with the small amount of wash water, because steam is supplied into the drum at the beginning of washing and laundry soaking as well as soil separation is performed smoothly.

At that time, laundry soaking and soil separation may be performed more quickly as well as more efficiently, because not only steam but also hot air is supplied into the drum 400 by turning on the ventilation fan 520 and the drying heater 510 for increasing the drum temperature and heating wash water.

Meanwhile, the steam generator 600 may supply wash water instead of steam into the drum 400 for reducing the time for the wash cycle or spinning cycle.

That is, in case that only wash water, not steam, is needed, the steam generator 600 is operated in a state where the heater 640 is off. Thereby, wash water may be supplied into the drum 400 also through the steam generator 600.

Thus, the time needed for supplying wash water may be reduced to shorten the entire washing time, because wash water scheduled to be supplied into the drum 400 is supplied through the two water inlet paths respectively connected with the drawer for detergent 700 and with the steam generator 600.

Next, in a drying cycle of the drum type laundry machine with a drying function, the operation of steam generator will be described.

Once a drying cycle starts in the drum type laundry machine with a drying function, power is applied to the drying heater 510 within the drying duct 500 and at the same time the ventilation fan 520 is driven, such that hot air is generated within the drying duct 500 and supplied into the drum 400.

Together with that, the steam generator 600 is operated to generate steam and the generated steam is supplied into the drum 400 through the tub.

Hence, the hot air and the steam generated together are drawn into the drum 400 for drying the laundry.

That is, since not only hot air but also steam is supplied into the drum during the drying cycle, the drum temperature may be increased quickly.

Thus, the laundry within the drum 400 may be quick-dried as well as sterilized and wrinkles thereof also may be smoothed cut, resulting in a refreshing effect.

Next, in the other cycles of the drum type laundry machine with a drying function except the washing and drying cycle, the operation of steam generator will be described.

Once a refresh cycle for sterilizing the laundry and smoothing out wrinkles of the laundry starts in the drum type laundry machine with a drying function, the steam generator 600 generates and supplies steam into the drum 400 through the tub 300.

That is, only steam is supplied for smoothing out wrinkles of the laundry and sterilizing the laundry instead of washing or drying the laundry.

Thus, user satisfaction may be enhanced the to minimized wrinkles of laundry and sanitary washing.

It is preferred that the drum 400 is rotated in case that the steam generator 600 is operated in a washing, drying and refreshing cycle so that supplying the steam generated by the steam generator 600 may be supplied to the laundry.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The laundry machine according to the present invention described above have the following advantageous industrial applicability.

The present invention has an advantageous industrial applicability of enhanced washing efficiency as well as economizing in wash water in a washing cycle.

Furthermore, the present invention has another advantageous industrial applicability of enhanced drying efficiency as well as removing wrinkles of laundry and sterilizing the laundry in a drying cycle.

Still further, the present invention has a third advantageous industrial applicability of enhancing user satisfaction due to the refreshing function of laundry.

Still further, the present invention has a fourth advantageous industrial applicability that steam is generated and supplied more efficiently, because wash water may be supplied by the steam generator in case of the counter-pressure of water in the steam generator.

The invention claimed is:

1. A laundry machine comprising:

a first body;

a water supply valve provided at the first body and connected with an outer water supply;

a drum rotatably mounted within the first body, laundry being loaded into the drum;

at least one steam generator to generate steam to be supplied into the drum;

a water regulator to regulate an amount of water supplied per predetermined time from the water supply valve to the steam generator, wherein the steam generator includes a predetermined water inflow space therein to allow water to flow therein, to generate steam from the flowing water and to supply the steam into the drum; and a steam supply pipe provided between the steam generator and the drum to supply the steam into the drum, wherein the steam generator comprises:

a steam generating part having the predetermined water inflow space therein to allow water to flow therein, the steam generating part having a water inlet and an outlet respectively communicating with the water inflow space;

a water inlet path connecting the water supply valve to the water inlet of the steam generating part;

an outlet path connecting the outlet of the steam generating part to the steam supply pipe; and a heater to heat the flowing water through the inflow space from the water inlet of the steam generating part to the outlet of the steam generating part using the water pressure of the outer water supply to generate steam, and wherein the steam generated in the steam generator is supplied into the drum without a device for intentionally or selectively blocking the supplied steam.

2. The laundry machine of claim 1, wherein the water regulator is in a pipe connecting the water supply valve to the steam generator.

3. The laundry machine of claim 1, wherein the water regulator is a solenoid valve which opens/closes a path receiving water once the power is applied thereto.

4. The laundry machine of claim 3, wherein the solenoid valve regulates the water amount supplied to the steam generator by periodically repeating the opening/closing operation.

5. The laundry machine of claim 1, wherein the water regulator comprises:

a second body having an inlet formed at a first side thereof to draw water, an outlet formed at a second side thereof to discharge water and a water through hole formed between the inlet and the outlet; and a driving part to open/close the water-through hole.

6. The laundry machine of claim 1, wherein the steam generating part is provided within the first body of the laundry machine so that the outlet may be positioned higher than the water inlet based on a horizon line reference.

7. The laundry machine of claim 1, wherein the cross section of the steam generating part is larger than the cross section of the water inlet path and of the outlet path.

8. The laundry machine of claim 7, wherein the cross section of the outlet path is smaller than the cross section of the water inlet path.

9. The laundry machine of claim 1, wherein the water inlet path comprises a water supply pipe having a first end thereof connected with the water supply; and a water inlet pipe having a first end connected with a second end of the water supply pipe and a second end thereof connected with the water inlet of the steam generating part.

10. The laundry machine of claim 9, wherein the water regulator is in the water supply pipe.

11. The laundry machine of claim 1, wherein the steam generator further comprises a bypass path to discharge water that overflows from the water inflow space of the steam generating part.

12. The laundry machine of claim 11, wherein an end of the bypass path is in a water supply pipe portion that is between the water regulator and the water inlet pipe.

13. The laundry machine of claim 1, wherein the outlet path comprises:

an outlet pipe having a first end thereof connected with the outlet of the steam generating part; and the steam supply pipe having a first end connected with a second end of the outlet pipe and a second end thereof connected with the drum.

14. The laundry machine of claim 13, wherein the end of the steam supply pipe that discharges steam is formed in a nozzle shape.

15. A laundry machine comprising:

a first body;

a water supply valve provided at the first body and connected with an outer water supply;

a drum rotatably mounted within the first body, laundry being loaded into the drum;

a hot air supply device to generate and supply hot air into the drum through a drying duct;

at least one steam generator to generate steam to be supplied into the drum, the steam generator including a predetermined water inflow space therein to allow water to flow therein, to generate steam from the flowing water; and a water regulator to regulate an amount of water supplied per predetermined time from the water supply valve to the water inflow space from the water supply valve, wherein the steam generator comprises:

a steam generating part having the predetermined water inflow space therein to allow water to flow therein, the steam generating part having a water inlet and an outlet respectively communicating with the water inflow space;

a water inlet path connecting the water supply valve to the water inlet of the steam generating part;

an outlet path connecting the outlet of the steam generating part to the drum; and a heater to heat the flowing water through the inflow space from the water inlet of the steam generating part to the outlet of the steam generating part using the water pressure of the outer water supply to generate steam.

16. The laundry machine of claim 15, wherein the steam generated in the steam generator is supplied into the drum through the drying duct.

17. The laundry machine of claim 16, wherein the steam is supplied into the drum together with the hot air generated by the hot air supplying device.

18. The laundry machine of claim 15, wherein the water regulator comprises:

a second body having an inlet formed at a first side thereof to draw water therein, an outlet formed at a second side thereof to discharge water and a water-through hole formed between the inlet and the outlet; and a driving part to open/close the water-through hole.

19. The laundry machine of claim 18, wherein the water regulator comprises a coil;

a plunger that moves upwardly to open the water-through hole when power is applied to the coil;

a cylinder to guide the upward/downward movement of the plunger; and a compressing spring to provide restitution force to the plunger.

20. A laundry machine comprising:

a body;

a drum rotatably mounted within the body, laundry being loaded into the drum;

a water supply valve;

at least one steam generator to generate steam to be supplied into the drum, the steam generator including a predetermined water inflow space therein to allow water to flow therein, to generate steam from the flowing water;

a water regulator to adjust water from the water supply valve to be regularly supplied into the water inflow space without deviation according to the time basis;

a heater which heats water flowing through the water inflow space to generate steam; and a bypass path to discharge water that overflows from the water inflow space, wherein an end of the bypass path is in a water supply pipe portion that is between the water regulator and a water inlet pipe of the steam generator, wherein the steam generator comprises:

a steam generating part having the predetermined water inflow space therein to allow water to flow therein, the steam generating part having a water inlet and an outlet respectively communicating with the water inflow space;

a water inlet path connecting the water supply valve to the water inlet of the steam generating part;

an outlet path connecting the outlet of the steam generating part to the drum; and a heater to heat the flowing water through the inflow space from the water inlet of the steam generating part to the outlet of the steam generating part using the water pressure of the outer water supply to generate steam.

21. The laundry machine of claim 20, wherein the water regulator adjusts water amount supplied into the steam generator without deviation according to the water pressure deviation of water supply.

* * * * *